United States Patent [19]

Williams

[11] 4,061,274

[45] Dec. 6, 1977

[54] MATERIAL REDUCING APPARATUS AND METHOD OF OPERATING THE SAME

[75] Inventor: Robert M. Williams, Ladue, Mo.

[73] Assignee: Williams Patent Crusher and Pulverizer Company, St. Louis, Mo.

[21] Appl. No.: 708,889

[22] Filed: July 26, 1976

[51] Int. Cl.[2] ..... B02C 23/14

[52] U.S. Cl. ..... 241/24; 241/48; 241/52; 241/79.1; 241/80

[58] Field of Search ..... 241/23, 24, 48, 52, 241/53, 57, 59, 65, 79.1, 80

[56] References Cited

U.S. PATENT DOCUMENTS

| | | | |
|---|---|---|---|
| 1,783,358 | 12/1930 | Crites et al. | 241/59 |
| 1,991,583 | 2/1935 | Stockton | 241/23 |
| 2,935,267 | 5/1960 | Maxey | 241/24 |
| 3,826,208 | 7/1974 | Williams | 110/15 |

*Primary Examiner*—Granville Y. Custer, Jr.
*Attorney, Agent, or Firm*—Gravely, Lieder & Woodruff

[57] ABSTRACT

Method of and apparatus for reducing material by grinding and for handling the ground product in a system that minimizes the production of a product containing a high percentage of extreme fines so that the product is more uniform in size and the apparatus is more efficient in producing that product.

6 Claims, 1 Drawing Figure

MATERIAL REDUCING APPARATUS AND METHOD OF OPERATING THE SAME

BACKGROUND OF THE INVENTION

Figure 1:
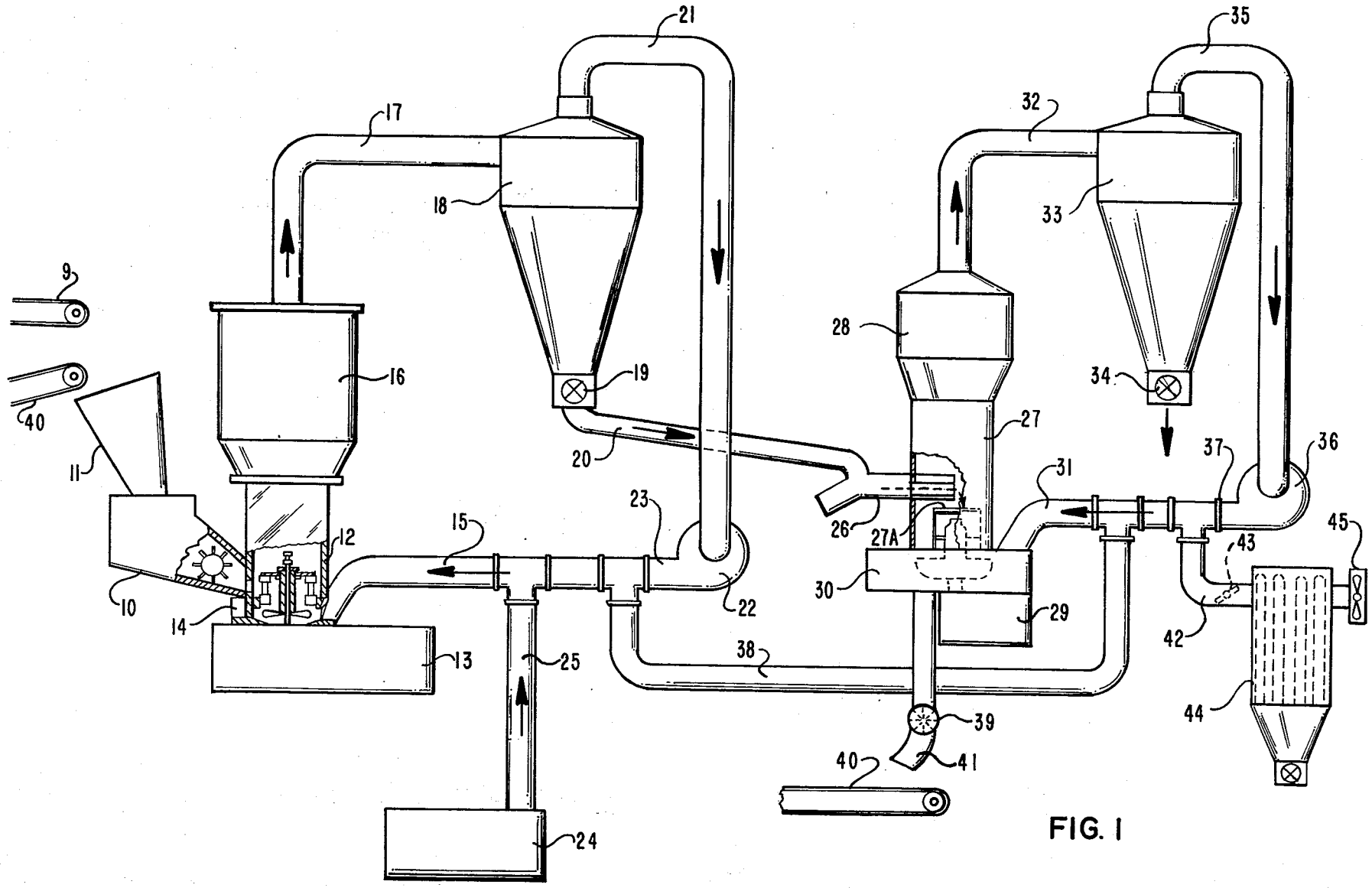

The grinding of material such as coal or clay in the usual grinding apparatus is frequently found to produce an excessive percentage of extremely fine particles which are difficult to handle. When such material contains moisture of the order of 15% or more the tendency for the coarse and fine particles to agglomerate is encouraged, with the result that the return of coarse particles to be reground in a grinding apparatus will be accompanied by fines sticking to the coarse particles. Thus, the fines are further reduced in size and the apparatus has its efficiency reduced because of the amount of material being rehandled and reground. A further problem with regrinding fines beyond the desired cut point (size) is the reduction in efficiency of the operating apparatus down stream in the furher processing.

The problem in reducing coal to a fineness in the range where approximately 70 percent will pass a 200 mesh screen, so as to make it suitable for coal gasification, is to prevent the coal from being reduced to an extreme fineness of the order of 44 microns or finer, because the fines easily escape the gasification processing apparatus and are lost.

The problem in reducing clay to a condition suitable for use as oil well drilling mud or in iron ore pellitizing, is to prevent reduction to extreme fineness. When clay contains as much as 30% to 40% moisture it is difficult to reduce it to a substantially uniform size. In addition to the moisture problem, extreme clay fines have a tendency to float and when placed in a container there is a period of time needed for the particles to settle down and compact so that a reasonable shipping weight can be reached. The waiting period is expensive and ties up shipping containers.

BRIEF SUMMARY OF THE INVENTION

This invention relates to a method of reducing material, such as coal or clay, to avoid excessive reduction, and to apparatus for practicing the method.

The method comprises initially under grinding or setting the mill for coarse reduction of the material so that a fluid bed of the material can be developed with a minimum of fines which pass a primary separator, subjecting the fluid bed to drying heat to reduce the tendency of the fines to stick to the larger coarse particles, feeding the reduced material to a classifying step where the residual material of coarse size is separated from the entraining air and is carried back to the initial grinding mill for further reduction, returning the entraining air to the coarse reduction along with hot drying gas, feeding a portion of the entraining air to the classifying step to develop a second fluid bed, and subjecting the material leaving the second fluid bed to a step of separating the final product from the circulating air which has performed the function of conveying the material through the steps of the method.

The apparatus for practicing the method includes a coarse reduction mill for generating a product that is oversize, means for collecting the coarse ground material in a fluid bed chamber where specific gravity separation of the material occurs so that the oversize material is returned for further reduction, means for conducting the air current responsive material from the specific gravity separator to a cyclone separating means where the material is separated from the entraining air and conducted to a fluid bed classifier for final sizing, means to circulate air through the foregoing system of components, and means to supply a hot gas for drying the material especially at the coarse reduction mill to reduce or overcome the problem of having a high percentage of the fines stick to the larger particles due to the moisture content of the material in its original state when brought to the apparatus.

DESCRIPTION OF THE DRAWING AND PREFERRED EMBODIMENT OF THE APPARATUS

The preferred apparatus for practicing the present invention is shown in the accompanying single drawing view which is a generally schematic flow diagram in which the items of apparatus are denoted for the purpose of practicing the method.

In the drawing the material delivered by conveyor 9 to be reduced is received at the feed device 10 through an inlet chute 11. The feeder 10 is connected into a material reducing mill 12 above the grinding rollers. The rollers are driven from a central shaft (such as a roller mill shown generally in Williams U.S. Pat. No. 3,826,208, granted July 30, 1974) which has its operating drive mounted in the housing 13. The mill is provided below the level of the rollers with an air supply bustle 14 which is connected to a conduit 15 supplied with air in a manner to be described presently. The outlet from the reducing mill 12 is connected to a material separator chamber 16 where a separation process takes place by specific gravity of the material. In operation the separator chamber and mill cooperate with an adequate supply of air to form a fluid bed of material that may range in size from overly coarse to fine. The overly coarse material will fall counter to the air stream and return to the mill 12 by gravity and the remainder of the material will be entrained in the air flow and directed by conduit 17 to a conventional cyclone separator 18 where the heavy material will be discharged through a suitable rotary valve 19 to conduit 20. The substantially clean air from the cyclone 18 will flow through conduit 21 to the suction side of a suitable blower 22. The outlet 23 of the blower 22 is connected into the previously mentioned conduit 15 at the mill bustle 14.

A particularly troublesome problem in handling friable material, such as coal, clay, and the like, containing moisture is that in reducing such material in the mill 12 the fines have a tendency to stick to the larger particles which are returned from the separator 16 to the mill for further reduction. The exposure of the fines to a second reducing operation still further reduces the size of the fines to a state where they become detrimental to the subsequent or following processing equipment. In order to reduce the interferring effect of the moisture brought into the reducing mill 12 by the original feed of material through feeder 10, a source 24 of oxygen deficient hot gas is connected by a conduit 25 into the conduit 23 in advance of its connection to conduit 15. The hot gas is delivered through conduit 15 to the bustle 14 and produces a drying effect on the material being reduced in mill 12 and material forming the fluid bed in the separator chamber 16 so that the drying effect of the heat will retard or reduce the tendency of the fines to stick to the larger material. The beneficial effect of introducing the hot drying gas to the mill 12 is to increase the efficiency of the mill by reducing the amount of material that tends to stick together and is caused by this fact to return for further reduction from the mill 12.

It can be seen in the drawing that the material allowed by valve 19 to flow through conduit 20 from the cyclone separator 18 is directed into a feeding mechanism 26 associated with a classifier 27 where the material will undergo a classifying operation with the cooperation of a second separation chamber 28 connected to the outlet of the classifier 27. Classifier 27 has its operating or drive mechanism located in a suitable housing 29, and the classifier is provided with an air feeding bustle 30 which receives air from conduit 31. The drive in housing 29 rotates a material distribution plate 27A which, with air flow, separates the loose fines from the larger particles these fines make up the material passing out the top of the chamber 28 to flow through conduit 32 to a conventional cyclone separator 33 where the material now of desired final size is collected and discharged through a suitable rotary valve 34. Any suitable means may be provided to receive the material discharged through the valve 34. The gas outlet from the cyclone separator 33 is conducted by conduit 35 to the suction side of a blower 36 whose outlet 37 is connected to the conduit 31 leading into the bustle 30.

In order to overcome any tendency of the fines reaching classifier 27 to stick or cling to the particles that may separate out by specific gravity and return to the reducing mill 12 through air lock 39 by means of conveyor 40, there is provided a heated or drying air source by means of by-pass conduit 38 which is connected from the outlet 23 of blower 22 to the outlet 37 of blower 36. After an initial period of operation of the reducing mill 12 and blower 22, with consequence feeding of oxygen deficient hot drying gas into the apparatus from the source 24, the flow system associated therewith will have a significant reduction in moisture content and a portion of the thus dried and oxygen deficient gas will be supplied through the by-pass conduit 38 to the flow at conduit 31 for the bustle 30 of the classifier 27. In this way the material subjected to final separation in the classifier 27 will be handled under a reduced humidity condition so that the efficiency of the classifier 27 and the action of the chamber 28 will not be significantly disturbed.

The action of the classifier 27 will allow oversize material to move out through the air lock 39 to conveyor 40 and return to the feed means 10 at the mill 12. The conveyor 40 is generally conventional, but for clear presentation it has been shown with the receiving end under the discharge chute 41 and the discharge end at the inlet chute 11. This feature simplifies the action taking place in the classifier 27 and permits the attainment of improved results in the uniformity of final particle size delivered at the outlet valve 34 from the cyclone separator 33. A further feature is that the return of material on conveyor 40 to the inlet chute 11 aids in drying the fresh material brought into the apparatus by the delivery conveyor.

It is to be understood that while the drawing view has disclosed a schematic flow diagram, the reducing mill 12 may be of the roller or impact type, and for purposes of the diagram the mill is shown with the characteristic configuration of a roller mill. The operation of the apparatus develops a fluid bed in the separator 16 and in the classifier 28 respectively, and the action of the fluid beds in each case is enhanced by the introduction of the hot drying gas so that the piggyback effect of the fines sticking to the larger particles returning by specific gravity for further reduction is largely prevented. The material that is already reduced to substantially the desired size passes out of the fluid bed in the classifier 28 and only th coarser particles are returned by conveyor 40 for further reduction. In this way the overall efficiency of the apparatus is substantially increased, the production of extreme fine material is significantly reduced and a more uniform final product is discharged through the valve 34 from the second cyclone separator 33.

Since the source of hot gas 24 adds a certain volume to the system, the system is provided with an exhaust vent conduit 42, and a control valve 43 is inserted in the vent line for purposes of exhausting vapor laden medium and obtaining the desired balance in the volume of circulating medium. The vent conduit 42 is connected to a bag house 44 where any residual fines and dust is collected before the cleaned air is exhausted to atmosphere by fan 45.

The foregoing apparatus furnishes an extremely valuable method for producing a commercially usuable product which may be coal of a size suitable for gasification, or the product may be clay suitable for oil well drilling mud or for the production of iron ore pellets. While coal and clay have been specifically mentioned, the apparatus has applications to other materials.

What is claimed is:

1. A method of reducing the size of a moisture carrying friable material while reducing regrinding of the finer fractions comprising the steps of: connecting up in a first air circulating system and in series order a material grinding mill, a fluid bed separator chamber, a first cyclone separator and a blower; introducing the friable material to the first system at the grinding mill, passing the output of said grinding mill through the fluid bed separator chamber to separate the finer fraction from the coarser and heavier fraction which returns to the grinding mill for further reduction, and discharging ground material from the first system at the cyclone separator while returning the air from the blower to the grinding mill; connecting up in a second air circulating system and in series order a material classifier, a second cyclone separator and a second blower; introducing to the second system at the material classifier the material discharged at the first cyclone separator from the first system; classifying the material introduced from the first system in the second system into acceptable and oversize fractions; and discharging the acceptable fraction at the second system cyclone separator while returning the oversize fraction to the first system at the grinding mill.

2. The method in accordance with claim 1 and comprising introducing an oxygen deficient hot gas into the first system between said blower and said grinding mill to supply the hot gas into the grinding mill to lower the moisture content of the material reduced therein, and supplying a portion of the oxygen deficient gas from the first system into the second system between said second blower and said material classifier.

3. The method in accordance with claim 1 and comprising operating the grinding mill to produce initially regrindable oversize material larger than approximately a size to pass a 200 mesh screen, and utilizing the fluid bed separator chamber to separate by specific gravity said regrindable material from the portion of smaller material responsive to the circulating air.

4. Apparatus for reducing the size of a moisture carrying friable material while reducing the sticking of fines on the material subject to regrinding comprising, a material reducing mill having an inlet for the moisture carrying friable material to be reduced in size and an outlet for reduced material; a fluid bed material separator connected to said mill outlet in position to receive the material reduced in said mill and separate it according to weight, said heavier fractions returning to said mill through said outlet; cyclonic separator means connected in material flow relationship to receive material from said fluid bed separator and deliver it to an outlet; blower means having a suction inlet connection with said cyclonic separator means and an outlet connected into said mill, said blower circulating air through said mill, fluid bed separator and cyclonic separator means to transport the reduced material from said mill and fluid bed separator to said cyclonic separator means and to return air substantially free of material to said mill; a source of oxygen deficient hot gases connected into blower means outlet, whereby the moisture carrying material is, at least, partially dried to avoid the finer fractions sticking to the heavier fractions and returning to said mill for subjection to regrinding, material classifier means connected to receive material from said cyclonic separator means outlet, a second cyclonic separator means and a second blower means connected in series relation with said classifier means, said second blower means creating a flow of air to carry reduced material from said classifier means to said second cyclonic separator means, said second cyclonic separator means having an outlet for reduced material of substantially desired size, and a material transfer connection between said material classifier means for said mill for the return of coarse material to said mill for regrinding.

5. The apparatus set forth in claim 4 wherein there is a flow connection from the outlet of the first mentioned blower means to the outlet of said second blower means for the transfer of heated air into said classifier means.

6. The apparatus set forth in claim 4 wherein there is a hot gas connection from said blower means outlet into said material classifying means, whereby the returned oversize material is further subject to moisture reduction in advance of return to said reducing mill inlet.

* * * * *

UNITED STATES PATENT AND TRADEMARK OFFICE

CERTIFICATE OF CORRECTION

PATENT NO. : 4,061,274

DATED : December 6, 1977

INVENTOR(S) : Robert M. Williams

It is certified that error appears in the above-identified patent and that said Letters Patent are hereby corrected as shown below:

Column 5, line 19 - word "said" has been omitted before -blower means outlet-

Column 6, line 10 - namely, the word "for" should be "and" before -said mill-

Signed and Sealed this

Second Day of May 1978

[SEAL]

Attest:

RUTH C. MASON
Attesting Officer

LUTRELLE F. PARKER
Acting Commissioner of Patents and Trademarks